US009759401B2

(12) United States Patent
Schroll

(10) Patent No.: US 9,759,401 B2
(45) Date of Patent: Sep. 12, 2017

(54) LIGHT HAVING A COVER PANEL

(75) Inventor: Katrin Schroll, Matzing (DE)

(73) Assignee: Siteco Beleuchtungstechnik GmbH, Traunreut (DE)

( * ) Notice: Subject to any disclaimer, the term of this patent is extended or adjusted under 35 U.S.C. 154(b) by 0 days.

(21) Appl. No.: 13/639,800

(22) PCT Filed: Apr. 6, 2011

(86) PCT No.: PCT/EP2011/001713

§ 371 (c)(1),
(2), (4) Date: Dec. 13, 2012

(87) PCT Pub. No.: WO2011/124372

PCT Pub. Date: Oct. 13, 2011

(65) Prior Publication Data

US 2013/0114257 A1 May 9, 2013

(30) Foreign Application Priority Data

Apr. 7, 2010 (DE) ..... 10 2010 014 099

(51) Int. Cl.
*F21V 3/00* (2015.01)
*F21S 8/08* (2006.01)
(Continued)

(52) U.S. Cl.
CPC ..... *F21V 3/00* (2013.01); *F21S 8/086* (2013.01); *F21V 3/02* (2013.01); *F21V 3/0472* (2013.01);
(Continued)

(58) Field of Classification Search
CPC ..... F21S 8/086; F21S 2/005; F21S 48/215; F21S 48/225; F21S 48/2262;
(Continued)

(56) References Cited

U.S. PATENT DOCUMENTS 530,192 A * 12/1894 Mason ..... B60L 5/40 191/27
2,194,841 A * 3/1940 Welch ..... F21V 7/005 362/217.05
(Continued)

FOREIGN PATENT DOCUMENTS

DE 20 2008 009 797 10/2008
DE 10 2010 007 774 8/2011
(Continued)

*Primary Examiner* — Anh Mai
*Assistant Examiner* — Fatima Farokhrooz
(74) *Attorney, Agent, or Firm* — Cozen O'Connor

(57) ABSTRACT

A lamp, comprising at least one light source (3), arranged in a housing (1) having at least one light exit opening, and at least one reflector (4), which is shaped in such a way that the light coming from the light source (3) is divided into at least two light beams, the light exit opening being at least partially covered by a cover panel (5), which has two surface portions (5*a*, 5*b*) on which the respectively corresponding light beams impinge, the surface portions (5*a*, 5*b*) being shaped in such a way that the predominant part of the light beams that is respectively directed onto a surface portion (5*a*, 5*b*) impinges on the surface portion (5*a*, 5*b*) at an angle of incidence which is less than 60°, in order to reduce the reflections from the cover panel (5).

24 Claims, 1 Drawing Sheet

(51) Int. Cl.

| | |
|---|---|
| ***F21V 3/02*** | (2006.01) |
| ***F21V 3/04*** | (2006.01) |
| ***F21V 7/04*** | (2006.01) |
| ***F21V 13/04*** | (2006.01) |
| ***F21V 7/00*** | (2006.01) |
| *F21S 2/00* | (2016.01) |
| *F21W 131/10* | (2006.01) |
| *F21W 131/103* | (2006.01) |
| *F21Y 105/00* | (2016.01) |
| *F21Y 115/15* | (2016.01) |
| *F21Y 115/10* | (2016.01) |

(52) U.S. Cl.

CPC ..... *F21V 7/0083* (2013.01); *F21V 7/048* (2013.01); *F21V 13/04* (2013.01); *F21S 2/005* (2013.01); *F21W 2131/10* (2013.01); *F21W 2131/103* (2013.01); *F21Y 2105/00* (2013.01); *F21Y 2115/10* (2016.08); *F21Y 2115/15* (2016.08)

(58) Field of Classification Search

CPC .. F21S 48/2281; F21S 48/236; F21S 48/2287; F21V 3/02; F21V 3/0472; F21V 7/048; F21V 13/04; F21V 3/00; F21V 7/0083; F21V 7/0091; F21V 2200/13; F21Y 2115/10; F21Y 2105/00; F21Y 2115/15; F21Y 2103/00; F21Y 2113/00; F21Y 2113/20; F21W 2131/103; F21W 2131/10; G02B 6/0001; G02B 6/0021; G02B 6/0068; B60Q 3/64; B60Q 3/43; B64C 2027/8236; B64D 2011/0038; C02F 1/281

USPC ..... 362/241–248, 514, 516–518, 520–522, 362/223, 224, 217.02, 217.03, 217.04, 362/217.05, 217.06, 217.07, 341, 346, 362/347, 348, 349, 350, 351, 326–336

See application file for complete search history.

(56) References Cited

U.S. PATENT DOCUMENTS 3,641,334 A * 2/1972 Kipping ..... A45C 15/06 362/135
4,178,072 A * 12/1979 Rogers ..... G02B 23/04 359/448
4,219,867 A * 8/1980 Zehender ..... F21S 48/114 359/485.04
4,496,211 A * 1/1985 Daniel ..... G02B 6/262 385/147
4,499,528 A * 2/1985 Hawlitzki ..... B60Q 3/44 362/245
4,747,667 A * 5/1988 Tanaka ..... G02B 3/0068 359/621
4,992,695 A * 2/1991 Naum ..... F21V 19/0005 313/113
5,245,175 A * 9/1993 Inabata ..... G02B 7/346 250/201.8
5,394,310 A * 2/1995 Iwasaki ..... 362/538
5,526,190 A * 6/1996 Hubble, III ..... F21V 7/0091 347/102
5,555,161 A * 9/1996 Roe ..... B60Q 3/024 116/202
5,764,412 A * 6/1998 Suzuki ..... G02B 27/285 349/5
5,964,525 A * 10/1999 Albou ..... 362/522
6,726,346 B2 * 4/2004 Shoji ..... 362/328
6,851,834 B2 * 2/2005 Leysath ..... F21S 8/04 362/240
7,121,705 B2 * 10/2006 Albou ..... F21S 48/1266 362/517
8,042,960 B2 * 10/2011 Hikmet ..... F21S 48/114 362/19
8,123,388 B2 * 2/2012 Ookubo ..... 362/512
8,210,714 B2 * 7/2012 Chao ..... G02B 3/0056 359/619
2003/0063360 A1 * 4/2003 Ishihara ..... 359/212
2004/0218380 A1 * 11/2004 Taylor ..... A01M 1/145 362/122
2004/0246606 A1 * 12/2004 Benitez ..... G02B 3/02 359/858
2005/0111235 A1 * 5/2005 Suzuki ..... B60Q 1/2696 362/555
2005/0224074 A1 * 10/2005 Steneby ..... F21S 11/00 126/698
2005/0237766 A1 * 10/2005 Klettke ..... B60Q 3/004 362/612
2005/0265041 A1 * 12/2005 Wimbert ..... F21S 48/215 362/545
2005/0286253 A1 * 12/2005 Strobl ..... 362/341
2006/0028829 A1 * 2/2006 Amano ..... F21S 48/215 362/505
2006/0083003 A1 * 4/2006 Kim ..... F21V 5/04 362/327
2006/0109669 A1 * 5/2006 Tanaka ..... F21K 9/00 362/459
2006/0119250 A1 * 6/2006 Suehiro ..... B60Q 1/2696 313/498
2006/0126343 A1 * 6/2006 Hsieh ..... F21K 9/00 362/327
2006/0152932 A1 * 7/2006 Wu ..... F21V 5/04 362/327
2006/0268555 A1 * 11/2006 Kelly ..... F21K 9/137 362/341
2007/0024990 A1 * 2/2007 Paek ..... G02B 6/0018 359/725
2007/0127253 A1 * 6/2007 Kawashima et al. ..... 362/509
2007/0279908 A1 * 12/2007 Alcelik ..... 362/283
2008/0303757 A1 * 12/2008 Ohkawa ..... F21V 5/04 345/82
2009/0008662 A1 * 1/2009 Ashdown ..... H01L 25/0753 257/98
2009/0052193 A1 * 2/2009 Zweig ..... G02B 6/0018 362/327
2009/0071467 A1 * 3/2009 Benitez ..... F24J 2/085 126/685
2009/0168394 A1 * 7/2009 Hikmet ..... F21S 48/114 362/19
2009/0268469 A1 * 10/2009 Huang ..... H04N 9/315 362/308
2009/0316414 A1 * 12/2009 Yang ..... F21S 4/008 362/296.01
2010/0110671 A1 * 5/2010 Gordin et al. ..... 362/228
2010/0118531 A1 * 5/2010 Montagne ..... 362/235
2010/0165652 A1 * 7/2010 Ookubo ..... F21S 48/1154 362/522
2010/0195335 A1 * 8/2010 Allen ..... F21V 5/048 362/309
2011/0008035 A1 * 1/2011 Messina et al. ..... 396/200
2011/0164426 A1 * 7/2011 Lee ..... 362/335
2012/0287511 A1 * 11/2012 Dross et al. ..... 359/641

FOREIGN PATENT DOCUMENTS

EP 1 925 878 5/2008
EP 2 133 621 12/2009

* cited by examiner

LIGHT HAVING A COVER PANEL

RELATED APPLICATIONS

This is a U.S. National Phase Application under 35 USC 371 of International Application PCT/EP2011/001713 filed on Apr. 6, 2011.

This application claims the priority of German application no. 10 2010 014 099.6 filed Apr. 7, 2010, the content of which is hereby incorporated by reference.

The present invention relates to a lamp having a cover panel, and in particular to an outside lamp, such as for example a street lamp or luminaire, having a cover panel.

BACKGROUND OF THE INVENTION

It is known to provide lamps with a cover panel to protect the reflector and the light source from soiling or damage. Such cover panels are formed in a flat or tray-like manner. Since stray light escapes from the cover panels, it is advantageous to use a flat cover panel in cases where it is intended to avoid the emission of a component of the light into the region to the rear of the lamp as well as possible, in order for example to avoid facades from being illuminated. In addition, in certain countries there are regulations and standards that prohibit light from being radiated into the sky and can only be conformed to by flat cover panels. Tray-like coverings are then disadvantageous, since stray light is diffused into the region to the rear of the lamp from the parts of the tray-like covering that project from the light exit opening of the lamp.

On the other hand, flat cover panels have the disadvantage that rays from the light source impinging on the light exit plane of the lamp at a shallow angle are reflected back by the cover panel more intensely into the reflector and into the lamp and cannot exit.

SUMMARY OF THE INVENTION

It is one object of the present invention to provide a lamp having a cover panel in which reflections from the cover panel of light from the light source of the lamp are reduced and with which an emission of 0% into the region to the rear of the lamp or the sky can be achieved more easily.

The lamp according to one aspect of the invention comprises at least one light source, arranged in a housing having at least one light exit opening, and at least one reflector, which is shaped in such a way that the light coming from the light source is divided into at least two light beams, the light exit opening being at least partially covered by a cover panel, which has two surface portions on which the respectively corresponding light beams impinge, the surface portions being shaped in such a way that the predominant part of the light beams that is respectively directed onto a surface portion impinges on the surface portion at an angle of incidence which is less than 60°, in order to reduce the reflections from the cover panel.

In the case of the lamp according to an embodiment of the invention, the reflections from the cover panel are reduced, since the cover panel is shaped in such a way that as great a proportion of the light as possible impinges on the cover panel at an angle of incidence that involves a low degree of reflection, and the transmission of light through the cover panel is as great as possible or maximized. Ideally, the cover panel is shaped in such a way that its surface contour exactly follows the angular distribution of the light coming from the primary lens of the lamp, so that all the rays of the light impinge on the cover panel at an angle of 90° or an angle of incidence of 0°. Here, the angle of incidence refers to the angle between the normal to the surface of the cover panel and the direction of the incident light.

In addition, the cover panel can be formed in such a way that it has only a small height above the primary lens of the lamp, so that as little light as possible is emitted into the region to the rear behind the reflector or into the sky. The light radiated into the region to the rear of the lamp behind the reflector can be additionally reduced by a rim on the housing of the lamp, which may also be formed by a housing projection. An emission of 0% into the region to the rear of the lamp can also be achieved by the cover panel not projecting at any point beyond the rim of the housing of the lamp or from the light exit opening that is formed by the rim of the housing.

The cover panel according to the invention is particularly suitable for point sources of light, such as for example LEDs, LED arrays or OLEDs, and reflectors, which produce a plurality of substantially independent light beams and consequently serve different angular regions. However, conventional light sources, such as for example high-pressure lamps, may also be used.

According to a preferred embodiment, the part of the light beam that impinges on the surface portion at the angle of incidence concerned comprises more than 75%, more than 90% or more than 95% of the stream of light directed onto the surface portion.

According to a further preferred embodiment, the surface portion is shaped in such a way that the light beam incident on it impinges with an angle of incidence of at least 45° or less, at least 30° or less, at least 20° or less or 10° or less. The angle of incidence refers to the angle between the normal to the surface portion and the direction of the incident light.

According to a further embodiment, the surface portion is convex, concave, arched or curved or has the form of a wave with an apex extending in a linear or arcuate manner. A wave form is considered to be, in particular, a form that in cross section extends between two minima via a maximum or between two maxima via a minimum lying in between.

According to a further embodiment, the surface portion has in cross section the form of a curve with an extremum, the curve being symmetrical or asymmetrical with respect to the extremum. If the curve is asymmetrical, this means that the curve has a greater slope on one side of the extremum than on the other side. As a result, account can be taken in particular of unsymmetrical angular distributions of the light in a light beam. The extremum may be a maximum or a minimum. Correspondingly, the surface portion has a convex or concave form. In a plan view, the surface portion may have a symmetrical, round, elliptical, angular, in particular rectangular, square, polygonal or asymmetrical form.

According to a further preferred embodiment, the lamp comprises one or more reflectors, which produce more than two light beams, the cover panel having a number of assigned surface portions corresponding to the number of light beams. The surface portions may have the same form and may together form the overall surface of the cover panel. On the other hand, it is also conceivable to provide in addition to the surface portions supplementary surface portions with which the surface portions can be supplemented to form the overall cover panel.

According to a further preferred embodiment, the lamp comprises a number of reflectors arranged in a row with light sources respectively assigned to them, the light beams of neighboring reflectors that come from the reflectors being superposed on one another. Depending on the orientation and the form of the reflectors, various desired light intensity distribution curves of the lamp can be achieved thereby.

According to a further preferred embodiment, the reflector has the form of a bent tube having two light exit openings at the ends, the light source being arranged in the middle of the tube. Further details with respect to a reflector according to this embodiment are disclosed in the German patent application 10 2010 007 774.7. The scope of this disclosure with respect to the reflector is included in the disclosure content of the present patent application. The reflector has, in particular, funnel-shaped openings at the ends of the bent tube. According to a further embodiment, the light source comprises one or more LEDs, LED arrays or OLEDs.

According to a further embodiment, the cover panel is formed in a rectangular or round manner and comprises a wavy form with two or more wave maxima, which extend linearly or annularly, in particular rotationally symmetrically. Such a cover panel is suitable in particular for a lamp with a rectangular or round housing and corresponding linearly or annularly, in particular rotationally symmetrically, arranged reflectors for covering a corresponding light exit opening, the reflectors of the wavy form that are arranged next to one another in the lamp producing corresponding light beams. In the case of a corresponding annular arrangement of the reflectors, the light beams may also be superposed on one another to form an annular light beam.

According to a further embodiment, the cover panel is provided with an antireflective coating or is treated so as to be antireflective. This allows the degree of reflection of the light from the cover panel to be additionally reduced.

BRIEF DESCRIPTION OF THE DRAWINGS

Further features, properties and advantages of the present invention emerge from the following description of an exemplary embodiment on the basis of the appended drawing, in which.

DETAILED DESCRIPTION OF THE DRAWINGS

Figure 1:
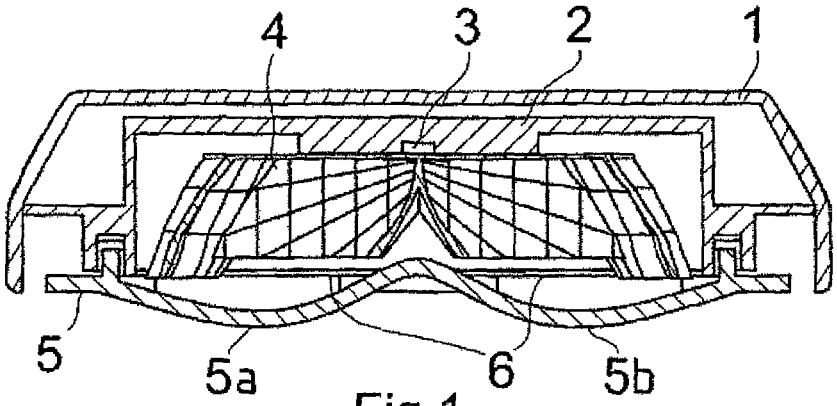
FIG. 1 shows a lamp according to an exemplary embodiment of the invention having a cover panel in cross section.
Figure 2:
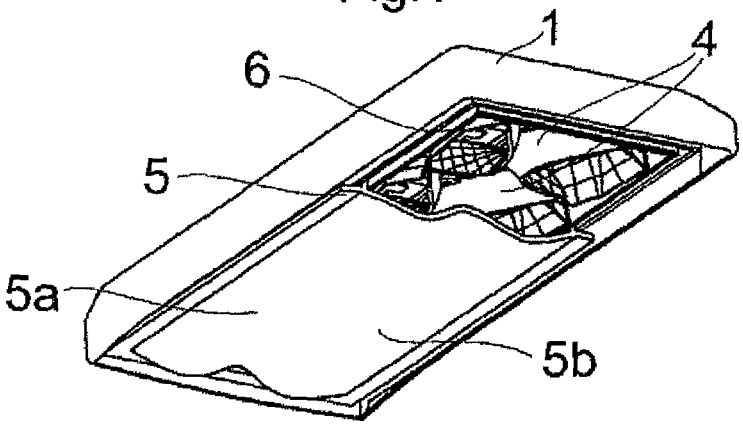
FIG. 2 shows the lamp according to the embodiment shown in FIG. 1 in a view perspectively from below.

The lamp according to the invention is described on the basis of an exemplary embodiment with reference to FIGS. 1-3. The lamp 1 according to the embodiment shown comprises a housing 1, on the upper side of which an LED module housing 2 is arranged. A number of reflectors 4 are fastened next to one another on the LED module housing 2.

The reflectors 4 of a tubular form respectively comprise a tube which has a constriction in the middle in the longitudinal direction. In the region of the constriction, a light source 3, which may for example comprise one or more LEDs, is arranged on the LED module housing 2. The tube widens in a funnel-shaped manner from the constriction to the annular light exit openings 6. A proportion of at least 10% of the overall stream of light emitted by the LEDs can exit from the light exit openings 6 without being reflected from the reflector surface as a light beam. The reflective surface inside the tube is partially or completely faceted.

As described in further details in DE 10 2010 007 774, this "3-zone reflector" produces as a result of its tubular form two light beams, which exit at the light exit openings of each reflector 4. The arrangement of a number of reflectors parallel to one another has the effect of superimposing on one another the light beams that exit from the light exit openings 6 that are arranged on the same side with respect to the longitudinal axis of the lamp. However, the light intensity emitted directly underneath the light source is reduced, since light emitted perpendicularly downward from the light source 3 impinges on the reflector 4 and, inter alia, exits laterally at a shallow angle from the respective light exit opening 6. The radiation characteristic of the lamp 1 is such that a significant proportion of light is emitted in the direction of the two longitudinal sides of the lamp 1. Accordingly, a large proportion of light exits at a shallow angle from the light exit openings 6.

Figure 3A:
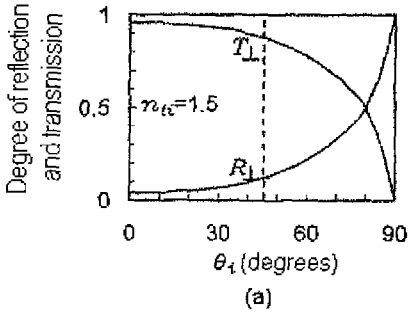
FIG. 3 shows two graphs, which show the degree of reflection and the transmission in dependence on the angle of incidence on a transparent surface for light that is polarized perpendicularly (FIG. 3*a*) and in parallel (FIG. 3*b*).
Figure 3B:
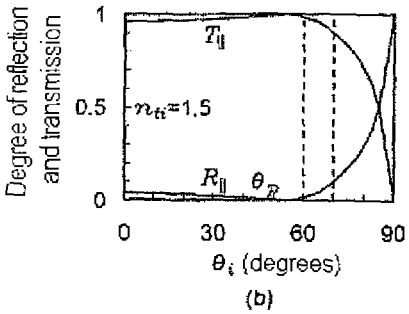

A cover panel 5 is arranged on the underside of the housing 1. The cover panel 5 may be produced from glass or plastic. As can be seen in particular in FIG. 1, the cover panel 5 comprises two wavy surface portions 5*a*, 5*b*. The apexes of the waves of the surface portions 5*a*, 5*b* extend parallel to the longitudinal side of the lamp 1, as can be seen in FIG. 2. The two surface portions 5*a*, 5*b* are connected to each other by a wave trough. As stated above, in the wave trough relatively little light passes through the cover panel 5, since the light exit openings 6 of the reflector 4 are arranged to the sides thereof. On account of the arched surface of the two surface portions 5*a*, 5*b*, rays coming directly from the light source 3 and rays coming from the reflector surface that exit from the light exit openings 6 of the lamp at a small angle impinge at a greater angle on the cover panel 5 than in the case of a flat cover panel 5 oriented parallel to the light exit openings 6. The lowering of the angle of incidence $\theta_i$ allows reflections from the cover panel 5 to be reduced in a manner according to the dependence that is represented in FIGS. 3*a* and 3*b*.

As can be seen in FIG. 3, for rays impinging on a cover panel 5, the degree of reflection ($R_\perp$=polarized perpendicularly, $R_\parallel$=polarized in parallel) increases with increasing angle of incidence, i.e. increasing angle between the normal to the surface and the direction of incidence of the light. On account of the arching of the cover panel 5, however, the degree of reflection can be reduced in comparison with a planar or flat cover panel.

In addition, the cover panel 5 comprises a small height, so that the proportion of stray light emitted to the rear side of the lamp 1 from the cover panel 5 remains small.

Numerous modifications can be made to the lamp shown by way of example without departing from the scope of the invention. In particular, the rim of the housing of the lamp 1 shown in FIGS. 1 and 2 may be extended in the direction transversely to the cover panel up to the height of the apexes of the waves of the cover panel 5, so that the cover panel 5 does not at any point project beyond the light exit opening of the lamp 1 formed by the rim of the cover panel 5, in order to achieve a 0% emission into the region to the rear of the lamp 1 or into the sky.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A lamp, comprising:

a housing having at least one light exit opening;

at least one light source arranged in the housing; and at least one reflector configured to divide light coming from each of the at least one light source into at least two separate light beams, the at least one reflector comprising two portions, each having a shape of a hollow funnel for receiving one of the at least two separate light beams, wherein each funnel widens from the at least one light source towards a light exit opening of the funnel that is directed towards the at least one light exit opening of the housing, wherein the at least two separate light beams exit the housing through the at least one light exit opening, where a light intensity between the separate light beams is reduced;

a cover panel configured to at least partially cover the light exit opening of each funnel, the cover panel having two surface portions on which the respectively corresponding light beams impinge, the surface portions shaped such that the at least two separate light beams that are respectively directed onto a respective of the at least two surface portions impinge on the surface portion at an angle of incidence which is less than 60°, in order to reduce the reflections from the cover panel wherein each of the surface portions of the cover panel has in cross section the form of a curve with an extremum, the curve being asymmetrical with respect to a center of the light exit opening of the funnel of the reflector that is at least partially covered by the respective surface portion of the cover panel.

2. The lamp as claimed in claim 1, wherein the part of the light beam that impinges on one of the surface portions at the angle of incidence comprises more than 75% of the stream of light directed onto the surface portion.

3. The lamp as claimed in claim 1, wherein the surface portion is shaped in such a way that the light beam incident on it impinges with an angle of incidence of less than 45°.

4. The lamp as claimed in claim 1, wherein the surface portion is convex, concave, arched or curved or has the form of a wave with an apex extending in a linear or arcuate manner.

5. The lamp as claimed claim 1, wherein the lamp comprises one or more reflectors, which produce more than two light beams, and the cover panel has a number of assigned surface portions corresponding to the number of light beams.

6. The lamp as claimed in claim 1, wherein the lamp has a number of reflectors arranged in a row with light sources respectively assigned to them, the light beams that come from the reflectors being superposed on one another.

7. The lamp as claimed in claim 1, wherein the reflector has the form of a bent tube having two light exit openings at the ends, a light source being arranged in the middle of the tube.

8. The lamp as claimed in claim 1, wherein the light source is an LED, an LED array or an OLED.

9. The lamp as claimed in claim 1, wherein the cover panel is formed in a rectangular or round manner and comprises a wavy form with two or more wave maxima.

10. The lamp as claimed in claim 1, wherein the cover panel is provided with an antireflective coating or is treated so as to be antireflective.

11. The lamp as claimed in claim 1, wherein the part of the light beam that impinges on one of the surface portions at the angle of incidence comprises more than 75%, more than 90% or more than 95% of the stream of light directed onto the surface portion.

12. The lamp as claimed in claim 1, wherein the surface portion is shaped in such a way that the light beam incident on it impinges with an angle of incidence of less than 45°, less than 30°, less than 20° or less than 10°.

13. The lamp as claimed in claim 1, wherein the light source is an LED, an LED array or an OLED.

14. A lamp, comprising:

a housing having at least one light exit opening;

at least one light source arranged in the housing; and at least one reflector configured to divide light coming from each of the at least one light source into at least two separate light beams, the at least one reflector comprising two portions, each having a shape of a hollow funnel for receiving one of the at least two separate light beams and each widening from the light source towards an annular light exit opening of the funnel, wherein the reflector further comprises at least two light exit openings which are substantially parallel to each other, wherein each of the at least two separate light beams passes through one of the two portions of the reflector and through one of the two light exit openings of the reflector so that a light intensity between the separate light beams is reduced;

a cover panel configured to at least partially cover the light exit opening of each funnel, the cover panel having two surface portions on which the respectively corresponding light beams impinge, the surface portions shaped such that the at least two separate light beams that are respectively directed onto a respective of the at least two surface portions impinge on the surface portions at an angle of incidence which is less than 60°, in order to reduce the reflections from the cover panel wherein each of the surface portions of the cover panel has in cross section the form of a curve with an extremum, the curve being asymmetrical with respect to a center of the light exit opening of the funnel of the reflector that is at least partially covered by the respective surface portion of the cover panel.

15. The lamp as claimed in claim 14, wherein that the part of the light beam that impinges on one of the surface portions at the angle of incidence comprises more than 75% of the stream of light directed onto the surface portion.

16. The lamp as claimed in claim 14, wherein the surface portion is shaped in such a way that the light beam incident on it impinges with an angle of incidence of less than 45°.

17. The lamp as claimed in claim 14, wherein the surface portion is convex, con-cave, arched or curved or has the form of a wave with an apex extending in a linear or arcuate manner.

18. The lamp as claimed in claim 14, wherein the lamp comprises one or more reflectors, which produce more than two light beams, and the cover panel has a number of assigned surface portions corresponding to the number of light beams.

19. The lamp as claimed in claim 14, wherein the lamp has a number of reflectors arranged in a row with light sources respectively assigned to them, the light beams that come from the reflectors being superposed on one another.

20. The lamp as claimed in claim 14, wherein the reflector has the form of a bent tube having two light exit openings at the ends, a light source being arranged in the middle of the tube.

21. The lamp as claimed in claim 14, wherein the cover panel is formed in a rectangular or round manner and comprises a wavy form with two or more wave maxima.

22. The lamp as claimed in claim 14, wherein the cover panel is provided with an antireflective coating or is treated so as to be antireflective.

23. The lamp as claimed in claim 14, wherein the part of the light beam that impinges on one of the surface portions at the angle of incidence comprises more than 95% of the stream of light directed onto the surface portion.

24. The lamp as claimed in claim 14, wherein the surface portion is shaped in such a way that the light beam incident on it impinges with an angle of incidence of less than 10°.

* * * * *